US005961429A

United States Patent [19]

Hsu

[11] Patent Number: 5,961,429

[45] Date of Patent: Oct. 5, 1999

[54] BASE OF EXERCISE DEVICE

[76] Inventor: Hank Hsu, 8F-14, No. 16, Lane 609, Sec. 5, Chung Hsin Rd., Sanchung, Taiwan

[21] Appl. No.: 09/033,412

[22] Filed: Mar. 2, 1998

[51] Int. Cl.[6] ..... A63B 26/00

[52] U.S. Cl. ..... 482/142; 482/148; 482/908; 248/291.1; 248/292.12; 248/292.13; 248/292.14

[58] Field of Search ..... 482/142, 908, 482/148, 123, 51, 52, 54, 53; 248/121, 122.1, 125.9, 291.1, 292.12, 292.13, 292.14, 346.01, 346.03

[56] References Cited

U.S. PATENT DOCUMENTS

| | | | |
|---|---|---|---|
| 1,211,765 | 1/1917 | Schmidt . | |
| 2,223,309 | 11/1940 | Swanson . | |
| 3,787,049 | 1/1974 | Rellinger | 482/142 |
| 4,696,470 | 9/1987 | Fenner | 482/142 |
| 5,203,755 | 4/1993 | Kaiser | 482/144 |
| 5,246,410 | 9/1993 | Fun | 482/53 |
| 5,277,684 | 1/1994 | Harris | 482/130 |
| 5,352,169 | 10/1994 | Eschenbach | 482/51 X |
| 5,460,586 | 10/1995 | Wilkinson | 482/51 X |
| 5,527,253 | 6/1996 | Wilkinson | 482/52 X |
| 5,529,552 | 6/1996 | Biedermann | 482/51 |
| 5,547,442 | 8/1996 | Carballosa | 482/46 |
| 5,810,702 | 9/1998 | Wilkinson | 482/142 |

*Primary Examiner*—Richard J. Apley
*Assistant Examiner*—William LaMarca
*Attorney, Agent, or Firm*—Browdy and Neimark

[57] ABSTRACT

A base for exercise devices is composed of a first rod member, a second rod member, a retaining mechanism, and a resilient member. The first rod member has two plates provided with a plurality of slots symmetrically. The second rod member is fastened pivotally with the two plates. The retaining mechanism is mounted on the second rod member and composed of a retaining member capable of a translational motion along the second rod member. The resilient member has an elastic force enabling the retaining member to undertake the translational motion so as to be releasably retained in the plates of the first rod member at such time when the second rod member is turned in relation to the first rod member to be coincident with any one of the slots of the two plates. The retaining member is released by the plates of the first rod member when the retaining member is exerted on by an external force greater than the elastic force of the resilient member.

6 Claims, 3 Drawing Sheets

BASE OF EXERCISE DEVICE

FIELD OF THE INVENTION

The present invention relates generally to an exercise device, and more particularly to a base of the exercise device.

BACKGROUND OF THE INVENTION

There are a variety of exercise devices of various volumes having to do with the structural complexity and the purpose of the exercise devices. In other words, a device designed for exercising all parts of a human body is bound to have a rather bulky volume. It is therefore conceivable that such bulky exercise device takes up a large area of the floor space, not to mention the high cost of making or shipping the exercise device. In general, the exercise devices consist of a base which is provided with the action elements, depending on the purpose and the function of the base. The base is mainly composed of a plurality of rodlike members. The volume of an exercise device is therefore dependent on the volume of the base. According to the conventional practice, the rodlike members of the base are connected by welding. However, the current practice involves the application of pivoting elements enabling the rodlike members to swivel in relation to one another. The rodlike members are provided with a plurality of locating holes and threaded holes engageable with pins or bolts for fastening pivotally the rodlike members such that the base can be folded or unfolded. However, such a foldable base as described above is difficult to use.

SUMMARY OF THE INVENTION

The primary objective of the present invention is to provide an easy-to-use base for exercise devices.

In keeping with the principle of the present invention, the foregoing objective of the present invention is attained by a base consisting of a first rod member, a second rod member, a retaining mechanism, and a resilient member. The first rod member has two plates provided with a plurality of slots. The second rod member is fastened pivotally with the two plates. The retaining mechanism is mounted on the second rod member and composed of a retaining member capable of a translational motion along the second rod member. The resilient member is located between the retaining mechanism and the second rod member for providing the retaining member with a force enabling the retaining member to undertake the translational motion. Both ends of the retaining member are engaged with a pair of slots of the two plates of the first rod member when the second rod member swivels in relation to the first rod member to arrive at the path of the translational motion of the retaining member to be coincident with any one of the slots of the two plates.

The foregoing objective, features and functions of the present invention will be more readily understood upon a thoughtful deliberation of the following detailed description of a preferred embodiment of the present invention with reference to the accompanying drawings.

BRIEF DESCRIPTION OF THE DRAWINGS

FIGS. 6 and 7 are a schematic view of a conventional pull slide mounted on the base according to the invention.

DETAILED DESCRIPTION OF THE INVENTION

Figure 1:
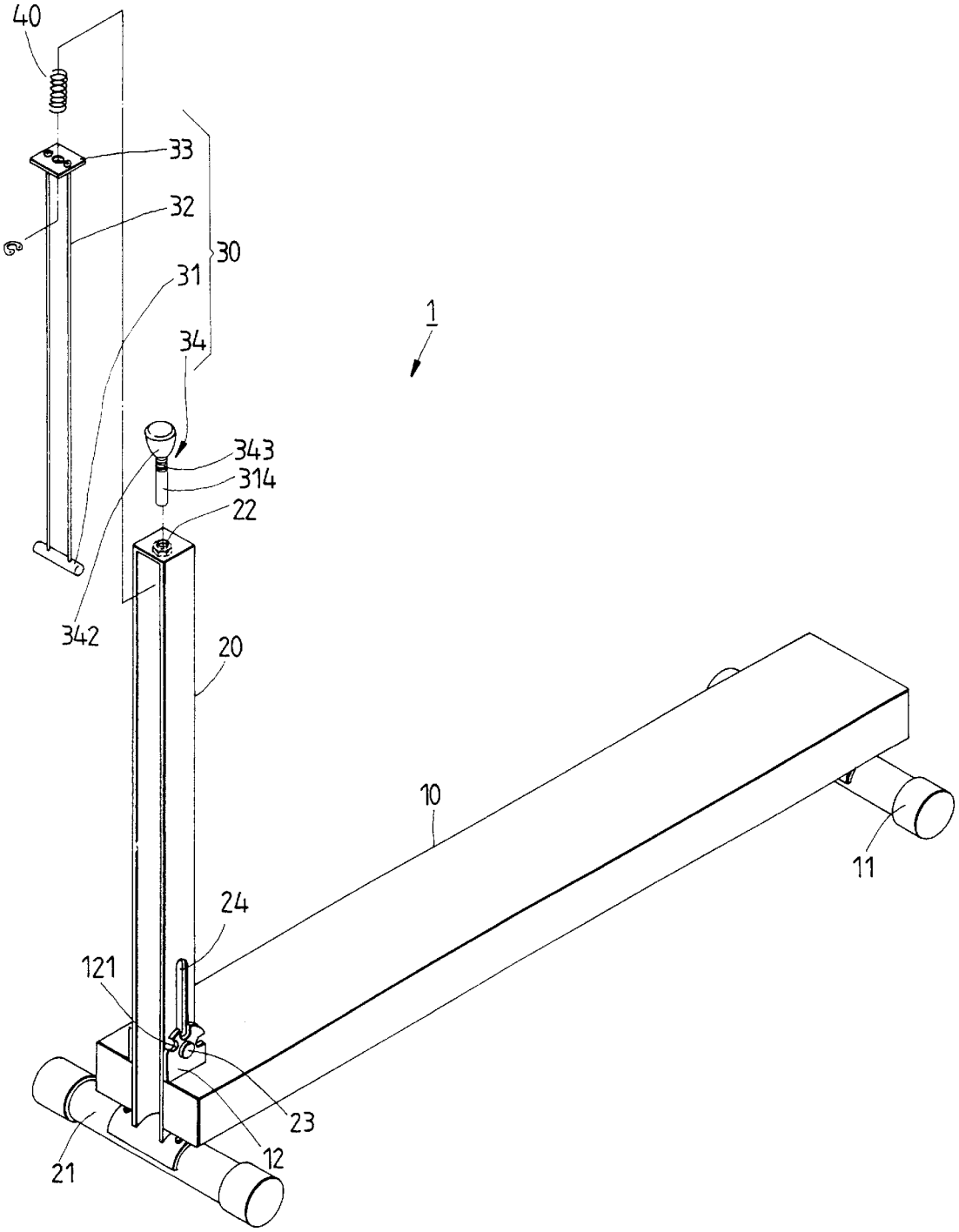
FIG. 1 shows an exploded view of the preferred embodiment of the present invention.
Figure 2:
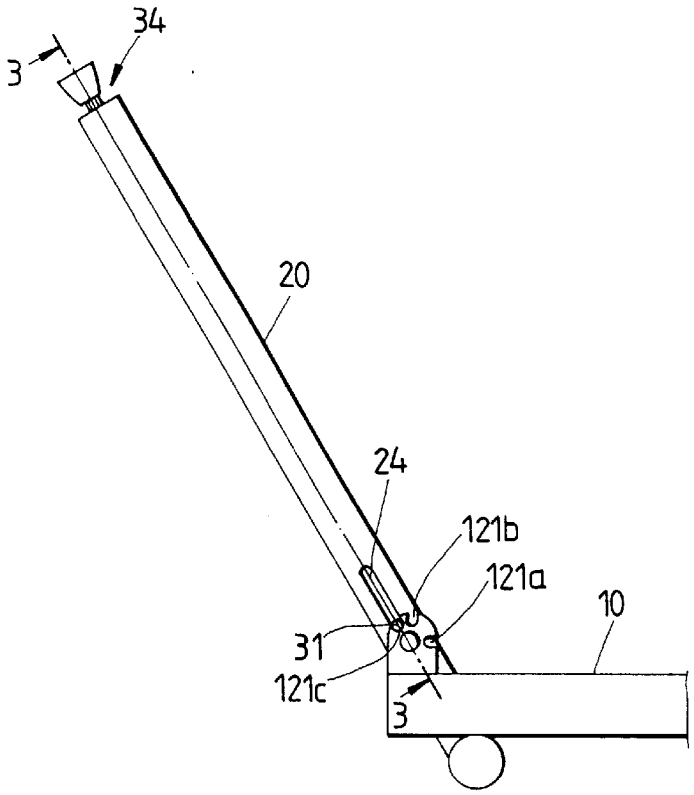
FIG. 2 shows a side view of the preferred embodiment of the present invention.

As shown in FIGS. 1 and 2, an exercise device base 1 embodied in the present invention is composed of a first rod member 10, a second rod member 20, a retaining mechanism 30, and a resilient member 40.

The first rod member 10 has an inverted U-shaped cross section and is provided at one end thereof with a first cross rod 11 and at another end thereof with two plates 12 which are parallel to each other and are provided respectively along the periphery thereof with a plurality of slots 121. The slots 121 of one of the two plates 12 are symmetrical with the slots 121 of another one of the two plates 12.

The second rod member 20 has an inverted U-shaped cross section and is fastened pivotally with the two plates 12 by a pivot 23 such that the two plates 12 are located on both sides of the second rod member 20, and that the second rod member 20 is capable of swiveling on the first rod member 10. The second rod member 20 is provided at one end thereof with a second cross rod 21 enabling the exercise device base 1 to rest stably on the floor or ground in conjunction with the first cross rod 11. The second rod member 20 is provided at another end thereof with a threaded hole 22, and is further provided respectively in two side walls thereof with a guide slot 24. The two guide slots 24 of the two side walls of the second rod member 20 are contiguous to the pivot 23 and symmetrical to each other. As the second rod member 20 is actuated to swivel on the first rod member 10, the guide slots 24 are sequentially coincident with the slots 121 of the two plates 12.

The retaining mechanism 30 is made up of a retaining member 31, two link members 32, one connection member 33, and a pull rod 34. The retaining member 31 is a short round rod and is located in the two guide slots 24 such that the retaining member 31 is capable of a translational motion along the path formed by the two guide slots 24, and that both ends of the retaining member 31 are jutted out of both sides of the second rod member 20, thereby enabling both ends of the retaining member 31 to engage the slots 121 at such time when the two guide slots 24 are coincident with any one of the two slots 121 of the two plates 12. The pull rod 34 has a round rodlike body 341 and a head 342 located at one end of the body 341. The body 341 is provided on the circumferential surface thereof with outer threads 343 contiguous to the head 342. The body 341 is inserted into the threaded hole 22 such that the outer threads 343 are engaged with the inner threads of the threaded hole 22 at the time when the pull rod 34 is turned in the positive direction. As a result, the pull rod 34 is securely located such that one end of the body 341 is rotatably connected with the connection member 33 inside the second rod member 20. The link members 32 are of a long round rodlike construction and are respectively connected with the retaining member 31 and the connection member 33. The link members 32 are located in the second rod member 20 for pulling or pushing the pull rod 34. The retaining member 31 can be actuated by the two link members 32 to engage in the translational motion in the guide slots 24.

The resilient member 40 is a tension spring and is located between the pull rod 34 and the second rod member 20 for providing the retaining member 31 with a force for bringing about the translational motion of the retaining member 31.

An action element such as a conventional pull slide as shown in FIGS. 6 and 7, can be mounted on the base 1 such that the action element can be operated by a user for bringing about the body-building effect. The second rod member 20 of the base 1 is capable of a pivoting movement in relation to the first rod member 10 so as to enable the base 1 to be folded or unfolded. When the second rod member 20 is in the midst of the pivoting movement and the two guide slots 24 are not coincident with the slots 121 of the two plates 12, the retaining member 31 is pushed by the elastic force of the resilient member 40 to press against the edge the two plates 12. On the other hand, when the two guide slots 24 are coincident with any one pair of slots 121 of the two plates 12, the retaining member 31 is pushed by the elastic force of the resilient member 40 to translate such that both ends of the retaining member 31 are engaged with the slots 121.

Figure 3:
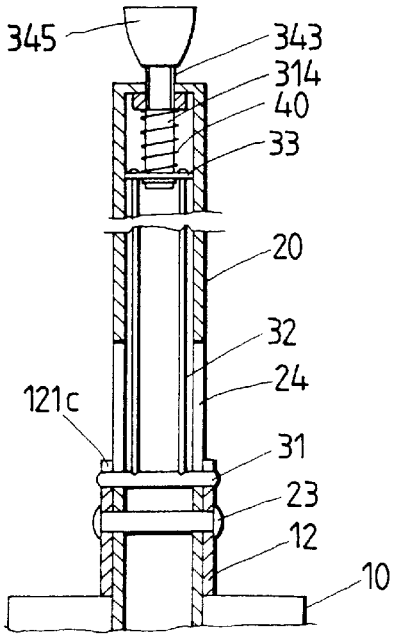
FIG. 3 shows a sectional view taken along the direction indicated by a line 3—3 as shown in FIG. 2.
Figure 4:
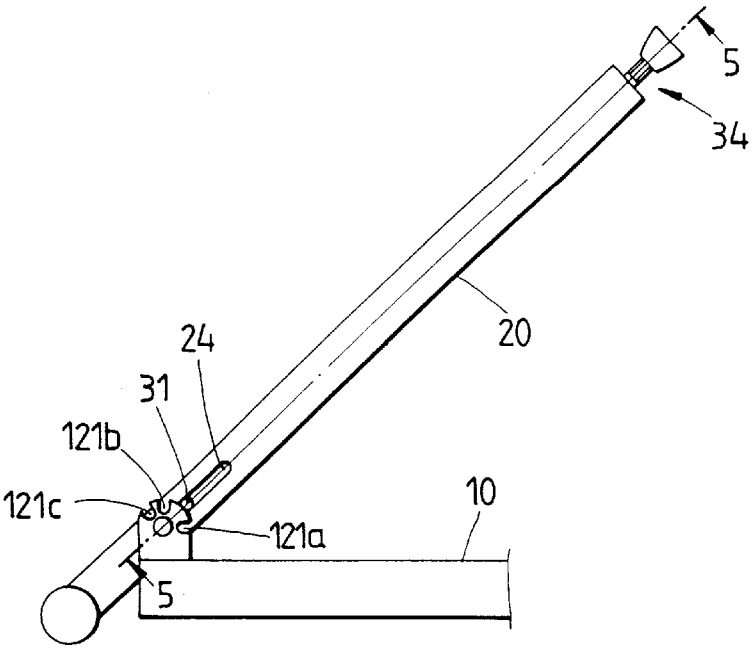
FIG. 4 shows another side view of the preferred embodiment of the present invention.
Figure 5:
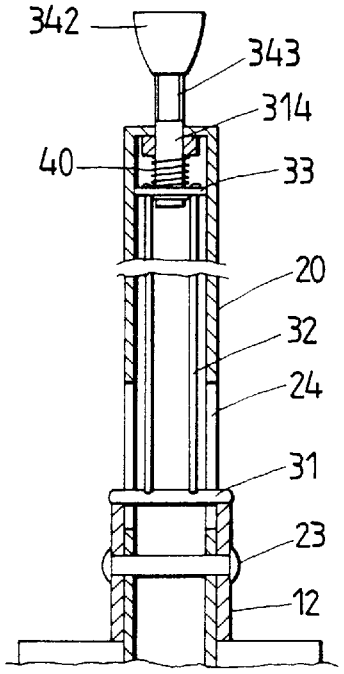
FIG. 5 shows a sectional view taken along the direction indicated by a line 5—5 as shown in FIG. 4.

As shown in FIGS. 2 and 3, the plates 12 are provided in the periphery thereof with three pairs of slots 121*a*, 121*b*, and 121*c*, which are capable of being coincident with the guide slots 24 of the second rod member 20 at such time when the angles formed by the first rod member 10 and the second rod member 20 are zero degree, 90 degrees, and 120 degrees respectively. When the second rod member 20 is turned such that the second rod member 20 and the first rod member 10 form a zero-degree angle, the base 1 is folded. If the angle formed by the second rod member 20 and the first rod member 10 is 90 degrees, base 1 is in a first unfolded state. If the angle formed by the second rod member 20 and the first rod member 10 is 120 degrees, the base 1 is in a second unfolded state. While the base 1 is in the first unfolded state and the second unfolded state, the retaining member 31 is engaged in the translational motion such that both ends of the retaining member 31 are retained in the slots 121 of the plates 12, so as to fix an angle formed by the first rod member 10 and the second rod member 10. However, the pull rod 34 can be easily actuated with hand to drive the link members 32 to cause the retaining member 31 to withdraw, thereby resulting in the disengagement of both ends of the retaining member 31 with the slots 121. In other words, the first rod member 10 and the second rod member 20 can be easily located and unlocated.

When the first rod member 10 and the second rod member 20 remain located, the pull rod 34 can be fastened securely with the second rod member 20 by rotating the pull rod 34 such that the outer threads 343 of the pull rod 34 are engaged securely with the inner threads of the threaded hole 22 of the second rod member 20. As a result, the first rod member 10 and the second rod member 20 can not be unlocated inadvertently once they are located.

What is claimed is:

1. A base, said base comprising:

a first rod member having two plates which are arranged in a parallel manner and are provided respectively along a periphery thereof with a plurality of slots, said slots of one of said two plates being symmetrical with said slots of another one of said two plates;

a second rod member fastened pivotally with said two plates;

a retaining mechanism fastened pivotally with said second rod member such that said retaining mechanism is capable of a pivoting movement in relation to said first rod member, said retaining mechanism consisting of a retaining member capable of a translational motion on said second rod member such that said retaining member is coincident with said slots of said plates sequentially at such time when said second rod member is in a process of turning in relation to said first rod member; and a resilient member located between said retaining mechanism and said second rod member for providing said retaining mechanism with an elastic force for bringing about the translational motion of said retaining member to enable both ends of said retaining member to be retained in said slots of said plates at such time when said second rod member is actuated to turn in relation to said first rod member until said second rod member is coincident with any one of said slots of said two plates, said retaining member capable of being disengaged with said plates at such time when said retaining member is exerted on by an external force greater than the elastic force of said resilient member.

2. The base as defined in claim 1, wherein said second rod member is provided respectively in two side walls thereof with a guide slot capable of being coincident with said slots of said plates at such time when said second rod member is turned in relation to said first rod member; and wherein said retaining member is received in said guide slots such that said retaining member is capable of translational motions along a path formed by said guide slots, and that said both ends of said retaining member are engaged with said slots of said plates at the time when said guide slots are coincident with any one pair of said slots of said two plates.

3. The base as defined in claim 1, wherein said retaining mechanism further consists of two link members and a pull rod mounted slidably on said second rod member such that said pull rod is fastened with said two link members which are in turn fastened with said retaining member.

4. The base as defined in claim 3, wherein said resilient member is located between said pull rod and said second rod member.

5. The base as defined in claim 3, wherein said retaining mechanism still further consists of a connection member for connecting said pull rod and said link members.

6. The base as defined in claim 5, wherein said second rod member is provided at one end thereof with a threaded hole; wherein said pull rod has a body and a head, said body provided with outer threads contiguous to said head and engageable with said threaded hole, said pull rod being connected with said connection member such that said pull rod can be turned in a positive direction, and that said outer threads of said body of said pull rod are engaged securely with inner threads of said threaded hole of said second rod member.

* * * * *